United States Patent [19]

Dedoro

[11] Patent Number: 4,694,381

[45] Date of Patent: Sep. 15, 1987

[54] LIGHT PROJECTOR FOR MOVABLE OPTICAL EFFECTS

[75] Inventor: Bruno Dedoro, Castel Goffredo, Italy

[73] Assignee: Coemar S.p.A., Castel Goffredo MN, Italy

[21] Appl. No.: 835,382

[22] Filed: Mar. 3, 1986

[30] Foreign Application Priority Data

Mar. 21, 1985 [IT] Italy ..... 19988 A/85

[51] Int. Cl.[4] ..... F21V 7/00

[52] U.S. Cl. ..... 362/307; 362/282; 362/291; 362/812

[58] Field of Search ..... 362/811, 307, 806, 269, 362/275, 317, 321, 329, 812, 290, 291, 292, 64, 170, 171, 166, 174, 182, 310, 325, 282, 74

[56] References Cited

U.S. PATENT DOCUMENTS

| | | | |
|---|---|---|---|
| 2,556,472 | 6/1951 | Gray | 362/812 |
| 3,271,735 | 9/1966 | Gosswillar | 362/74 |
| 4,387,362 | 6/1983 | Gosswillar | 362/170 |
| 4,458,303 | 7/1984 | Barns | 362/321 |
| 4,499,527 | 2/1985 | Tauber et al. | 362/282 |
| 4,575,786 | 3/1986 | Roberts | 362/291 |

*Primary Examiner*—Raymond A. Nelli

*Attorney, Agent, or Firm*—Guido Modiano; Albert Josif

[57] ABSTRACT

The light projector has the peculiar feature of comprising, within a disk-shaped enclosing body, a light source surrounded by a shaping diaphragm which is rotatable coaxially with the cited light source. Also provided, on said enclosing body, is a toroidal lens which extends preferably through 360° and focuses on said shaping diaphragm, being disposed concentrically with the cited light source.

17 Claims, 3 Drawing Figures

LIGHT PROJECTOR FOR MOVABLE OPTICAL EFFECTS

BACKGROUND OF THE INVENTION

This invention relates to a light projector for movable optical effects.

As is known, especially in discotheques, public halls, and the like, lights are currently used which have the function of creating an ambient effect of light beams in continuous movement.

In a typical embodiment, such lights generally comprise a spherical body which carries, across its surface, a plurality of lenses or objectives adapted for emitting a light beam by substantially focussing on the bulb filament.

Such spherical bodies are made to rotate about different axes so as to create an ambient effect of movement of the various light beams, which may have different colors.

That embodiment, while being in general use, fails to afford a variable range of light effects because such effects are limited in practice to the focussing of the various objectives, which extend substantially radially from the spherical body, on the bulb filament.

Furthermore, such lights are highly complicated to manufacture because a number of lenses must be installed on the light's body.

SUMMARY OF THE INVENTION

It is the aim of this invention to obviate such prior disadvantages by providing a novel type of light projector affording variation in the types of light images projected without restrictions from the lens being used.

Within the above aim, it is a particular object of the invention to provide a light projector for movable optical effects, which affords a range of movements which combine together to provide a continuous variation of the light effect which the user can adjust at will.

Another object of this invention is to provide a light projector wherein, in addition to the greatly enhanced effects, construction is simplified in practice and the light projector itself is more reliable.

A further object of this invention is to provide a light projector which is simple to manufacture and competitive from a purely economical standpoint.

The above aim, and these and other objects to become apparent hereinafter, are achieved by a light projector for movable optical effects, according to the invention, characterized in that it comprises, within an enclosing body, a light source surrounded by a shutter rotatable coaxially with said light source, there being also provided on said enclosing body a lens for focussing on said rotating shutter and extending across at least annular portions disposed concentrically about the axis of said light source.

BRIEF DESCRIPTION OF THE DRAWINGS

Further features and advantages will be apparent from the following description of a preferred, but not exclusive, embodiment of a light projector for movable optical effects, with reference to the accompanying illustrative and non-limitative drawings, where.

DESCRIPTION OF THE PREFERRED EMBODIMENTS

Figure 1:
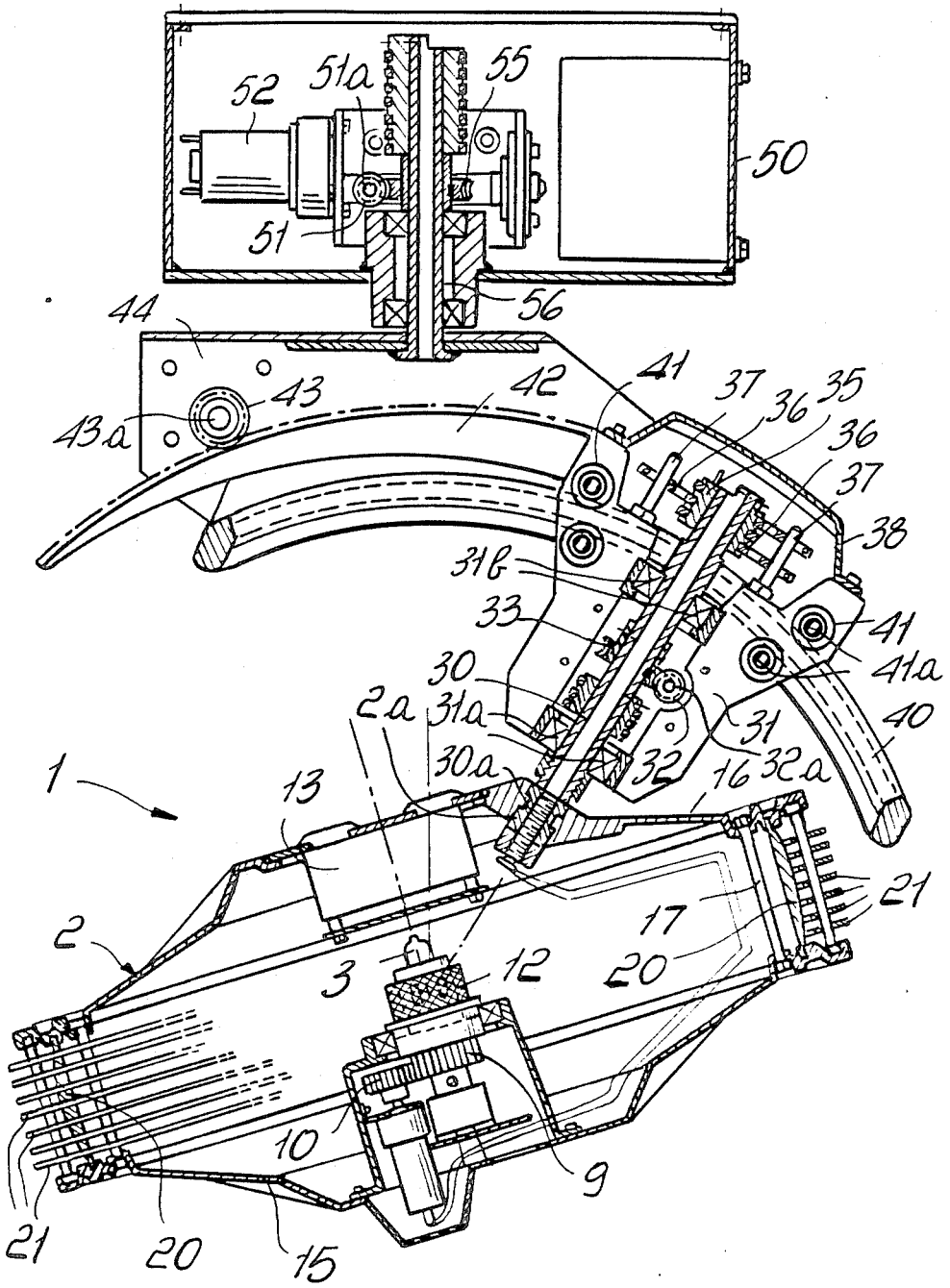
FIG. 1 shows a partly sectional view as taken on the vertical mid-axis of the light projector of this invention.
Figure 2:
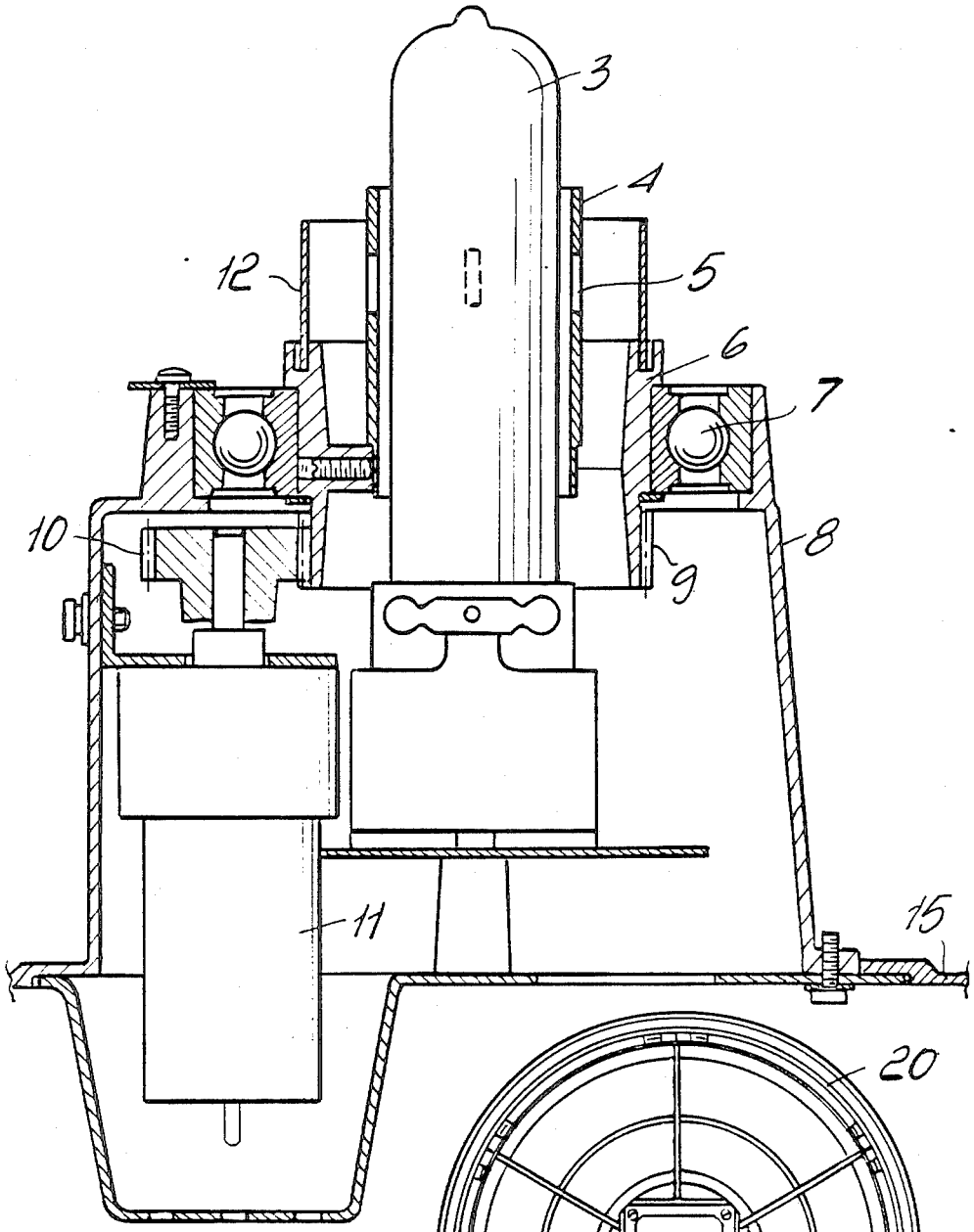
FIG. 2 shows in section, and to an enlarged scale, a detail view of the light source and the shaping diaphragm.
Figure 3:
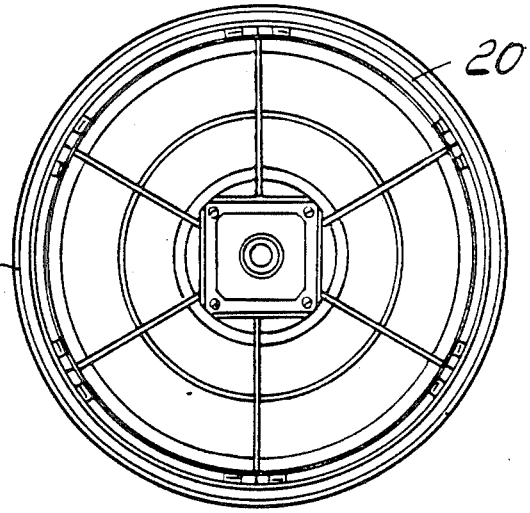
FIG. 3 is a plan view showing the inside of the enclosing body.

With reference to the cited drawing figures, the light projector for movable optical effects according to the invention, generally designated with reference numeral 1, comprises an enclosing hollow body, indicated at 2, which is preferably but not necessarily substantially disk-shaped.

Within the enclosing body 2, in a coaxial position with the body itself, is a light source expediently consisting of an incandescent lamp or bulb 3 of a commercially available type.

The bulb 3 is surrounded laterally by a rotating shutter 4 which has a tubular shape and may be provided with shaped apertures 5 for projecting light rays emitted from the bulb 3 outwards. Advantageously, a number of shutters having differently formed apertures may be interchangeably provided.

The shutter 4 is rotatable about the axis of the bulb 3, and for this purpose, the rotating shutter 4 is supported on a cylindrical section or portion 6 which is in turn rotatively supported, with the interposition of rolling bearings 7, on the structure or cylindrical body 8 connected to the body 2 itself. The cylindrical section 6 and the cylindrical body 8, as visible, thus define support means.

For effecting the rotary movement of the shutter 4, the cylindrical section 6 advantageously has, on one end thereof, a circumferential tooth formation 9 which meshes with a pinion gear 10 driven rotatively by a motor 11 housed within the enclosing body, the tooth formation 9, the pinion gear 10 and the motor 11 defining together motor drive means.

The cited enclosing body comprises a lower support shell 15 of substantially circular or disk-like shape which carries the bulb and the previously described assemblies, and an upper support shell 16, also of substantially circular or disk-like shape, which is joined to the lower shell 15 by bolts or the like fastening ties 17.

The shells 15 and 16 clamp on a lens 20 defining a lateral wall of substantially tubular shape before the first and second support shells 15, 16; the lens 20 being adapted for focussing the light beam emitted by the shutter 4, and which may advantageously extend into an annular configuration extending coaxial with the bulb 3, and the rotation axis of the shutter 4.

The lens 20, which may expediently define a substantially toroidal form, may advantageously be constructed from side-by-side segments or comprise a single annular element to provide a lens extending through 360°, or it may be made up of just portions of a circumference which may be separated by dividers which may be dark, transluscent, variously colored or otherwise arranged to provide desired optical effects.

It should be further added to the foregoing that a filter 12 of tubular shape may be provided around the rotating shutter 4, and spaced apart therefrom, to afford a number of colors as required.

Further, it should be pointed out that within the body 2, preferably on the upper shell 16, a fan 13 is provided for generating an air stream for cooling the lamp 3 in a conventional manner.

Externally of the lens 20, there are advantageously provided circumferential spaced fins 21 which, in addition to protecting the lens from the exterior also create additional particular optical effects.

The body 2, is supported on a hanging arm including a shaft 30 advantageously having a threaded portion 30*a* adapted for screw thread engagement relationship with an internally threaded sleeve 2*a*, rigidly associated with the body 2, such that the shaft 30 extends at an angle to the axis of the body 2, it forming advantageously an angle of substantially 45° with respect to the axis of the body 2 itself.

The shaft 30 is rotatable about its own axis and rotatably supported through bearings 31*a*, 31*b*, on a carriage 31 which has motor means including a first gear 32, supported for rotation about an axle 32*a* mounted on the carriage itself, being driven by a conventional motor (not illustrated), and meshing with a second gear 33, keyed to the shaft 30, and extending therearound, to set the shaft itself into rotation upon actuation of the motor; the gears 32 and 33 may be, for example, helical gears or the like elements.

Obviously, rotary motion generated by the cited motor may be imparted, to the first gear 32 either directly, by keying the gear to the output shaft of the motor, or via suitable kinematic transmission means such as belt or chain means.

Expediently, rigidly associated with the uppermost end of the shaft 30 is a sleeve 35 having formed thereon, circumferentially extending grooves adapted for sliding engagement relationship with annular plates 36, rigidly associated with the carriage 31 through connection bars 37, and advantageously covered by a cover element 38, removably associated with the carriage itself.

Thus, the enclosing body 2 can be set into rotation about the axis of the shaft 30 which is substantially inclined at 45° to the axis of the body itself.

The carriage 31 which carries the shaft 30 is rotatably movable on a guide bar 40 of arcuate configuration which extends over a portion of a circumference and is engaged by rollers 41, defining sliding means rotatably supported on the carriage itself, through respective axles 41*a*.

The guide 40 extends substantially perpendicularly to the shaft 30.

Movement of the carriage 31 along the guide 40 is accomplished by the engagement between a gear segment 42, or guiding projecting portion having a gear formation thereon, rigid with the carriage 31 and defining an extension corresponding to the longitudinal extension of the guide 40, and a gear wheel 43 mounted on an axle 43*a* defining drive means and being carried on a supporting holder 44 which defines the guide 40, such that it becmes possible to cause the carriage 31 and hence the shaft 30 which is supported thereon to assume an oscillatory movement.

The gear wheel may be powered, for example, by a small motor, kinematically or directly linked to the axle 43*a* and actuated for intermittent two way movement, to cause oscillation of the carriage with respect to the holder 44.

The holder 44 is in turn connected to an upper holder or supporting block 50 for rotation about a vertical axis through a motor 52 and transmission means 51, 51*a*, 55; in particular that rotation is accomplished by the coupling of a first upper gear 51 mounted on a rotation axle 51*a* supported on the supporting block 50 and connected to an upper motor 52, which first upper gear 51 meshes with a second upper gear or annular gear 55 which is keyed to a vertical shaft 56, rotatably journalled in bearings 56*a* associated with the supporting block 50 and being rigidly associated at its lowremost end with the holder 44.

Thus, a whole series of movements can be obtained which originate from the combination of the various movements defined by the rotation of the holder 44 about the vertical shaft 56, the sliding movement of the circumferentially extending guide 40 relatively to the holder 44, and rotation of the body 2 about the axis of the shaft 30 which extends substantially perpendicularly to the guide 40.

All the movements described above can be controlled in various ways and may take place at a variable speed and at music tempo, through the use of electronic devices known per se, to control the rotation speed of the various motors, and conventional sliding contacts may be provided for connecting the conventional power supply cables (not illustrated) to the motors and bulb.

Of particular importance is the fact that the rotating shutter may be replaced to modify the shape of the apertures provided thereon, so as to obtain a variation in the type of the light which is projected outwards.

The above-mentioned advantages are achievable in that the lens, which advantageously extends into an annular configuration, focuses the light beams emitted by the rotating shutter, even at an angle which may be up to 360°, thus obtaining a light emission into space which creates particular movement effects.

Another important aspect of the invention is the fact that the enclosing body, being supported for rotation about an axis lying substantially at 45° with respect to the axis of the enclosing body, creates movement situations which are specially pleasant and interesting.

The invention herein is susceptible to many modifications without departing from the scope of the inventive concept.

Furthermore, all the details may be replaced with technical equivalents thereof.

In practicing the invention, the materials used, so long as compatible with the specific use, and the dimensions and contingent shapes may be any suitable ones.

I claim:

1. A light projector for movable optical effects comprising:

a light source, a rotating shutter of substantially tubular shape surrounding said light source for partially passing light coming from said light source and emitting light beams, a hollow body enclosing said light source and said rotating shutter, said hollow body including first and second substantially disk-like shaped support shells extending opposed to and at a distance from each other, and a lateral wall of substantially tubular shape extending between said first and second support shells coaxially to said rotating shutter, said lateral wall including a focusing lens extending all around said rotating shutter for receiving and focusing said light beams emitted by said rotating shutter, support means in said enclosing body, rigidly connected to said first support shell and said light source and rotatively connected to said rotating shutter, motor drive means in said enclosing body resting on said first support shell, said motor drive means being connected to and rotatively driving said rotating shutter, and a hanging arm connected to and extending from said hollow body for hangingly supporting said hollow body.

2. A light projector for movable optical effects comprising:

a light source, a rotating shutter of substantially tubular shape surrounding said light source for partially passing light coming from said light source and emitting light beams, said rotating shutter having a rotation central axis extending through said light source, a hollow body enclosing said light source and said rotating shutter, said hollow body including first and second substantially disk-like shaped support shells extending opposed to and at a distance from each other, and a lateral wall of substantially tubular shape extending between said first and second support shells coaxially to said rotating shutter, said lateral wall including a focusing lens extending all around said rotating shutter for receiving and focusing said light beams emitted by said rotating shutter, support means in said enclosing body, rigidly connected to said first support shell and said light source and rotatively connected to said rotating shutter, motor drive means in said enclosing body resting on said first support shell, said motor drive means being connected to and driving said rotating shutter, and a hanging arm connected to and extending from said hollow body for hangingly supporting said hollow body, said hanging arm defining a hollow body rotation axis extending transversely to said rotation central axis and including motor means for rotating said hollow body together with said light source and said rotating shutter.

3. A light projector according to claim 2, wherein said rotating shutter comprises a tubular body having a plurality of throughgoing apertures for passing said light.

4. A light projector according to claim 2, wherein said support means includes a cylindrical body, a cylindrical portion and rolling bearing means, and said motor drive means includes a motor and a pinion gear driven by said motor, said cylindrical portion being rigidly connected to said first support shell and said light source, said cylindrical portion being rigidly connected to said rotating shutter and being rotatively supported by said cylindrical body through said rolling bearing means, said cylindrical portion having a tooth formation meshing with said pinion gear of said motor drive means.

5. A light projector according to claim 2, wherein said focusing lens has a toroidal shape extending through 360 around said rotating shutter, and said hollow body comprises tie means rigidly connecting said first and second support shells.

6. A light projector according to claim 2, wherein said hollow body rotation axis extends at substantially 45 with respect to said central rotation axis.

7. A light projector according to claim 2, comprising a colored filter having a tubular shape and surrounding said rotating shutter.

8. A light projector according to claim 2, comprising protection fins extending coaxially to said rotating shutter around said focusing lens.

9. A light projector according to claim 2, wherein said hanging arm comprises a rotation shaft having a first end rigidly connected to said second support shell of said hollow body and a second end rotatably connected to a movable carriage, said rotation shaft extending transversely to said rotation central axis and having gear means for engagement with said motor means.

10. A light projector according to claim 9, wherein said movable carriage comprises sliding means and a guiding projecting portion having a gear formation, said hanging arm further comprising a supporting holder having a guide bar for engagement with said sliding means and a gear wheel connected to drive means and meshing with said gear formation of said guiding projecting portion for driving said movable carriage back and forth along said guide bar.

11. A light projector according to claim 10, wherein said guide bar and said projecting portion have arcuate shapes.

12. A light projector according to claim 10, wherein said supporting holder further comprises a vertical shaft rigidly connected to said guide bar, said hanging arm further comprising an upper holder having a motor and transmission means interposed between said motor and said vertical shaft for rotating said vertical shaft and said supporting holder with said movable carriage around a vertical axis.

13. A light projector for movable optical effects comprising:

a light source, a rotating shutter of substantially tubular shape surrounding said light source for partially passing light coming from said light source and emitting light beams, said rotating shutter having a rotation central axis extending through said light source, a hollow body enclosing said light source and said rotating shutter, said hollow body including first and second substantially disk-like shaped support shells extending opposed to and at a distance from each other, and a lateral wall of substantially tubular shape extending between said first and second support shells coaxially to said rotating shutter, said lateral wall including a focusing lens having a toroidal shape extending through 360 around said rotating shutter for receiving and focusing said light beams emitted by said rotating shutter, support means in said enclosing body, rigidly connected to said first support shell and said light source and rotatively connected to said rotating shutter, motor drive means in said enclosing body resting on said first support shell, said motor drive means being connected to and driving said rotating shutter, and a hanging arm connected to and extending from said hollow body for hangingly supporting said hollow body, said hanging arm including:

(a) a rotation shaft having an end rigidly connected to one of said support shells of said hollow body and extending transversely to said rotation central axis of said hollow body, said rotation shaft further having gear means, (b) a movable carriage having motor means engaging with said gear means of said rotation shaft for rotatively driving said rotation axis, said movable carriage further comprising sliding means and a guiding projecting portion having a gear formation, (c) a supporting holder having a guide bar for engagement with said sliding means of said movable carriage and a gear wheel connected to drive means and meshing with said gear formation of said guiding projecting portion of said movable carriage for driving said movable carriage back and forth along said guide bar, said supporting holder further comprising a vertical shaft rigidly connected to said guide bar, (d) an upper holder having a motor and transmission means connected to said motor and said vertical shaft of said supporting holder for rotatively driving said vertical shaft and said supporting holder with said movable carriage and hollow shaft around a vertical axis.

14. A light projector according to claim 13, wherein said rotating shutter comprises a tubular body having a plurality of throughgoing apertures for passing said light.

15. A light projector according to claim 13, wherein said support means includes a cylindrical body, a cylindrical portion and rolling bearing means, and said motor drive means includes a further motor and a pinion gear driven by said further motor, said cylindrical portion being rigidly connected to said first support shell and said light source, said cylindrical portion being rigidly connected to said rotating shutter and being rotatively supported by said cylindrical body through said rolling beraing means, said cylindrical portion having a tooth formation meshing with said pinion gear of said motor drive means.

16. A light projector according to claim 13, wherein said focusing lens has a toroidal shape extending through 360 around said rotating shutter, and said hollow body comprises tie means rigidly connecting said first and second support shells.

17. A light projector according to claim 13, wherein said hollow body rotation axis extends at substantially 45 with respect to said central rotation axis.

* * * * *